US007452265B2

(12) United States Patent
Rambosek et al.

(10) Patent No.: US 7,452,265 B2
(45) **Date of Patent: *Nov. 18, 2008**

(54) ABRASIVE ARTICLE AND METHODS OF MAKING SAME

(75) Inventors: Thomas W. Rambosek, Woodbury, MN (US); Edward J. Woo, Woodbury, MN (US); Curtis J. Schmidt, South St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/614,431

(22) Filed: Dec. 21, 2006

(65) Prior Publication Data

US 2008/0153407 A1 Jun. 26, 2008

(51) Int. Cl.
*B24D 11/00* (2006.01)

(52) U.S. Cl. ..... 451/530; 451/533; 451/536; 451/539

(58) Field of Classification Search ..... 451/530, 451/533, 536, 539; 51/297, 300, 307
See application file for complete search history.

(56) References Cited

U.S. PATENT DOCUMENTS

| | | | |
|---|---|---|---|
| 1,850,413 | A | 3/1932 | Porte |
| 1,862,103 | A | 6/1932 | Stratford |
| 1,961,911 | A | 6/1934 | Pusch |
| 2,123,581 | A | 7/1938 | Anderson |
| 2,307,312 | A | 1/1943 | Whiting |
| 2,740,239 | A | 4/1956 | Ball et al. |
| 2,749,681 | A | 6/1956 | Reidenbach |
| 2,838,890 | A | 6/1958 | McIntyre |
| 2,984,052 | A | 5/1961 | Mueller, Jr. |
| 3,021,649 | A | 2/1962 | Robbins |
| 3,353,308 | A | 11/1967 | Zane |
| 3,420,007 | A | 1/1969 | Kolesh |
| 3,861,892 | A | 1/1975 | Wisdom, Jr. et al. |
| 3,932,966 | A | 1/1976 | Stern |
| 4,001,366 | A | 1/1977 | Brumlik |
| 4,062,152 | A | 12/1977 | Mehrer |
| 4,158,935 | A | 6/1979 | Robert |
| 4,282,011 | A | 8/1981 | Terpay |

(Continued)

FOREIGN PATENT DOCUMENTS

DE 34 16 186 A1 1/1985

(Continued)

OTHER PUBLICATIONS

"robAust", Roberlo Abrasives,Copyright © 2002-2006 robAust Pty Ltd., [retrieved from the internet on Jul. 6, 2006], URL <http://www.robaust.com/shopdisplayproducts.asp?id=30&cat=Roberlo+Abrasives>, pp. 2.

(Continued)

*Primary Examiner*—Maurina Rachuba

(57) ABSTRACT

An abrasive article with an integral dust collection system. The abrasive article comprises a porous abrasive layer with openings, a first filter media with channels, a second filter media, a third filter media with channels, a fourth filter media, and an optional attachment layer. The openings of the porous abrasive layer cooperate with the channels to allow the flow of particles from the abrasive surface to the filter media.

19 Claims, 4 Drawing Sheets

U.S. PATENT DOCUMENTS 4,287,685 A 9/1981 Marton
4,437,269 A 3/1984 Shaw
D277,486 S 2/1985 Yanagiura
4,590,113 A 5/1986 Herzog
4,609,581 A 9/1986 Ott
4,631,220 A 12/1986 Clifton
4,645,699 A 2/1987 Neveu
4,722,203 A 2/1988 Darjee
4,725,487 A 2/1988 Pemrick et al.
4,759,155 A 7/1988 Shaw
4,844,967 A 7/1989 Goralski et al.
4,920,702 A 5/1990 Kloss et al.
4,932,163 A 6/1990 Chilton et al.
4,937,984 A * 7/1990 Taranto ..... 451/524
4,964,243 A 10/1990 Reiter
4,964,245 A 10/1990 Braasch
5,007,206 A 4/1991 Paterson
5,036,627 A 8/1991 Walters
5,131,924 A 7/1992 Wiand
5,254,194 A 10/1993 Ott et al.
5,256,231 A 10/1993 Gorman et al.
5,317,886 A 6/1994 Prahl
5,354,591 A 10/1994 Ott et al.
5,367,839 A 11/1994 Pearce
5,389,032 A 2/1995 Beardsley
5,458,532 A 10/1995 Cannone
5,490,878 A 2/1996 Peterson et al.
5,505,747 A 4/1996 Chesley et al.
5,533,923 A 7/1996 Shanouilian et al.
5,560,794 A 10/1996 Currie et al.
5,578,343 A 11/1996 Gaeta et al.
5,607,345 A 3/1997 Barry et al.
5,616,394 A 4/1997 Gorman et al.
5,667,540 A 9/1997 Chesley et al.
5,674,122 A * 10/1997 Krech ..... 451/536
5,695,533 A 12/1997 Kardys et al.
5,807,161 A * 9/1998 Manor et al. ..... 451/442
5,810,650 A 9/1998 Jöst
5,891,549 A 4/1999 Beretta et al.
5,904,793 A 5/1999 Gorman et al.
5,954,844 A 9/1999 Law et al.
5,989,112 A 11/1999 Long et al.
6,024,634 A 2/2000 Höglund et al.
6,059,644 A 5/2000 Manor et al.
D426,560 S 6/2000 Texler
6,074,292 A 6/2000 Gilday
6,077,156 A 6/2000 Amin et al.
6,077,601 A 6/2000 DeVoe et al.
6,190,246 B1 2/2001 Parrott et al.
6,197,076 B1 3/2001 Braunschweig et al.
6,280,824 B1 * 8/2001 Insley et al. ..... 428/172
6,312,325 B1 11/2001 Van Osenbruggen
6,368,199 B1 4/2002 Van Osenbruggen
6,371,842 B1 4/2002 Romero
6,419,574 B1 7/2002 Takahashi et al.
6,482,308 B1 11/2002 Wiemann
6,575,821 B2 * 6/2003 Jost ..... 451/526
6,579,162 B2 6/2003 Chesley et al.
6,613,113 B2 9/2003 Minick et al.
6,687,941 B2 * 2/2004 Billat ..... 15/220.1
6,790,126 B2 9/2004 Wood et al.
6,923,840 B2 8/2005 Schutz et al.
D532,800 S 11/2006 Braunschweig
D533,200 S 12/2006 Braunschweig
D536,714 S 2/2007 Braunschweig
D538,312 S 3/2007 Braunschweig
D538,313 S 3/2007 Braunschweig
D541,317 S 4/2007 Braunschweig
7,244,170 B2 * 7/2007 Woo et al. ..... 451/527
7,329,175 B2 * 2/2008 Woo et al. ..... 451/530
2001/0044006 A1 11/2001 Kruegler
2003/0003856 A1 1/2003 Swei
2003/0127108 A1 7/2003 Policicchio et al.
2003/0143938 A1 7/2003 Braunschweig
2003/0159363 A1 8/2003 Chesley et al.
2004/0098923 A1 5/2004 Hood et al.
2004/0109978 A1 6/2004 Michel
2004/0148866 A1 8/2004 Krupnick
2004/0166788 A1 * 8/2004 Travis ..... 451/359
2004/0170801 A1 9/2004 Seth et al.
2004/0170802 A1 9/2004 Seth et al.
2004/0209561 A1 10/2004 Suzuki et al.
2005/0124274 A1 6/2005 Hoglund
2006/0019579 A1 1/2006 Braunschweig
2006/0148390 A1 * 7/2006 Woo et al. ..... 451/526
2007/0028525 A1 * 2/2007 Woo et al. ..... 51/298
2007/0028526 A1 * 2/2007 Woo et al. ..... 51/298
2007/0066197 A1 * 3/2007 Woo et al. ..... 451/527
2007/0066198 A1 * 3/2007 Rambosek et al. ..... 451/533
2007/0066199 A1 * 3/2007 Woo et al. ..... 451/533

FOREIGN PATENT DOCUMENTS

DE 41 24 520 A1 1/1993
DE 201 11 245 U1 8/2001
EP 0 064 748 A1 8/1984
EP 0 244 934 A2 11/1987
EP 0 166 060 A2 9/1988
EP 0 285 042 A1 10/1988
EP 0 578 865 A1 1/1994
EP 0 738 562 A2 10/1996
EP 1 488 888 A1 12/2004
EP 1 524 077 A1 4/2005
EP 1 733 844 A1 12/2006
FR 2 659 892 A1 9/1991
FR 2 739 308 4/1997
GB 1137556 12/1968
GB 1 539 477 1/1970
GB 2 017 485 A 10/1979
GB 2 057 483 A 4/1981
GB 2 162 213 A 1/1986
GB 2 199 053 A 6/1988
JP 5-220670 8/1993
JP 11-179668 7/1999
WO WO 90/14039 11/1990
WO WO 96/07509 3/1996
WO WO 00/64634 11/2000
WO WO 03/020474 A1 3/2003

OTHER PUBLICATIONS

"List of Products", Roberlo United States, © Copyright 2003 Roberloroberlousa.com, roberlo.com), [retrieved from the internet on Jan. 7, 2004], URL <http://www.roberlousa.com/abrasives.htm>, pp. 2.
U.S. Appl. No. 29/246,256, Shimizu et al., filed Mar. 28, 2006.
U.S. Appl. No. 29/246,257, Shimizu et al., filed Mar. 28, 2006.
U.S. Appl. No. 29/246,258, Shimizu et al., filed Mar. 28, 2006.
U.S. Appl. No. 29/246,259, Shimizu et al., filed Mar. 28, 2006.
U.S. Appl. No. 29/246,260, Shimizu et al., filed Mar. 28, 2006.
U.S. Appl. No. 29/246,261, Shimizu et al., filed Mar. 28, 2006.
U.S. Appl. No. 29/253,148, Braunschweig et al., filed Feb. 1, 2006.

* cited by examiner

ABRASIVE ARTICLE AND METHODS OF MAKING SAME

FIELD OF INVENTION

The present invention relates generally to an abrasive article. More particularly, the present invention relates to an abrasive article with an integral dust collection system.

BACKGROUND

Abrasive articles are used in industry for abrading, grinding, and polishing applications. They can be obtained in a variety of converted forms, such as belts, discs, sheets, and the like, in many different sizes.

Generally, when using abrasives articles in the form of "sheet goods" (i.e., discs and sheets), a back-up pad is used to mount or attach the abrasive article to the abrading tool. One type of back-up pad has dust collection holes connected by a series of grooves. The dust collection holes are typically connected to a vacuum source to help control swarf build-up on the abrading surface of the abrasive article. Removing the swarf, dust, and debris from the abrading surface is known to improve the performance of the abrasive article.

Some abrasive tools have integral vacuum systems with dust collection means. The extracting and holding capabilities of these abrasive tools have been limited, in part, due to the suction requirements of current abrasive disks that their related back-up pads require.

In some abrasive tool configurations, swarf is collected in a complex dust collection system through a hose connected to the abrasive tools. Dust collection systems, however, are not always available for the abrasive tool operator. Further, the use of a dust collection system requires hoses that can be cumbersome and may interfere with the operator's manipulation of the abrasive tool.

There is a continuing need for alternative ways to provide an abrasive system with dust extraction capabilities. It would be particularly desirable to provide an abrasive article that can be used with or without a central vacuum system.

SUMMARY

The present disclosure relates generally to an abrasive article. More particularly, the present disclosure relates to an abrasive article with an integral dust collection system having at least two filter media with channels. The combination of two filter media with channels has been shown to provide advantages over a single filter media with channels having dimensions comparable to the sum of the two single filter media with channels. That is, for example, an abrasive article comprises a combination of two 5 millimeter filter media with channels of the present invention has been demonstrated to provide a performance advantage over a comparable abrasive article comprising a single 10 millimeter filter media with channels.

In one aspect, the present disclosure provides an abrasive article comprising a porous abrasive layer with openings, a first filter media with channels, a second filter media, a third filter media with channels, a fourth filter media, and an optional attachment layer. The openings of the porous abrasive layer cooperate with the channels to allow the flow of particles from the abrasive surface to the filter media. The abrasive layer comprises a substrate having a first surface, a second surface opposite the first surface, a plurality of abrasive particles affixed to the first surface with at least one binder, and a plurality of openings extending from the abrasive surface to the second surface of the porous abrasive layer. The first and second filter media each comprise a plurality of channels that extend from the first surface of the filter media to the second surface of the filter media.

The porous abrasive layer of the abrasive article of the present disclosure can be an apertured coated abrasive, a screen abrasive, a nonwoven abrasive, or other porous abrasive materials known in the art.

In some aspects, the channels of the filter media with channels are formed from a stack of polymer films that form the channel sidewalls. The polymer sidewalls can comprise a structured surface and/or an electrical charge.

In some aspects, the second and fourth filter media comprises a nonwoven. In some aspects, each of the second and fourth filter media comprises a combination of filter materials, including, for example, 2, 3, 4, or more layers of similar or different filtering materials. The nonwoven can be formed of polyolefin fibers and can have a basis weight in the range of 10 to 200 grams per square meter.

In some aspects, the attachment layer is a pressure sensitive adhesive or comprises a loop portion or a hook portion of a two-part mechanical engagement system.

The abrasive article of the abrasive article of the present disclosure is useful for abrading a variety of surfaces including, for example, paint, primer, wood, plastic, fiberglass, and metal. The quantity and type of filter media can be modified allowing the manufacturer to optimize the performance of the abrasive article for a designated application. The abrasive article can be designed for use with or without a central vacuum system. In some embodiments, the abrasive article can be used with a tool having an integral vacuum system or a tool connected to a central vacuum system.

In another aspect, the present disclosure provides methods for making abrasive articles with integral dust collection capabilities.

The above summary of the abrasive article of the abrasive article of the present disclosure is not intended to describe each disclosed embodiment of every implementation of the abrasive article of the abrasive article of the present disclosure. The Figures and the detailed description that follow more particularly exemplify illustrative embodiments. The recitation of numerical ranges by endpoints includes all numbers subsumed with that range (e.g., 1 to 5 includes 1, 1.5, 2, 2.75, 3, 4, 4.80, and 5).

These figures, which are idealized, are intended to be merely illustrative of the abrasive article of the present disclosure and non-limiting.

DETAILED DESCRIPTION

Figure 1A:
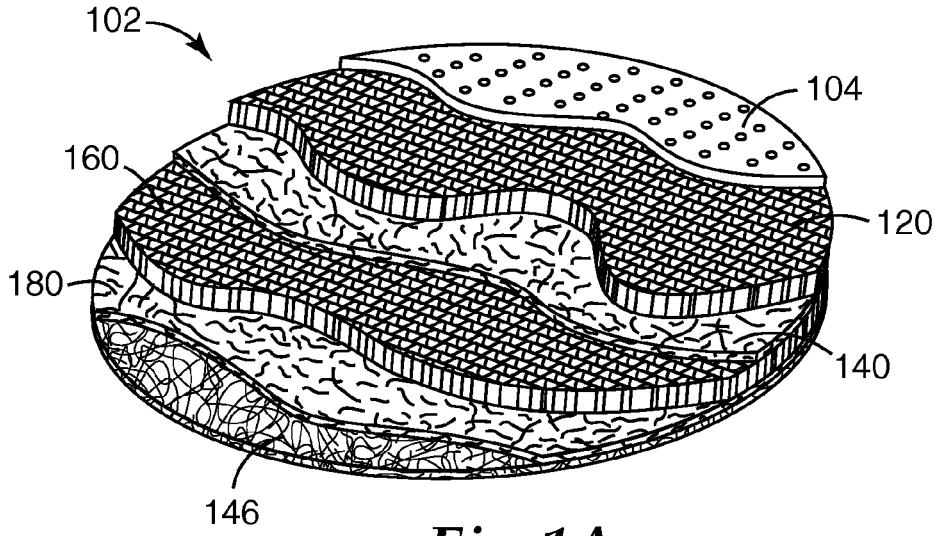
FIG. 1A is a perspective view of an exemplary abrasive article according to the present disclosure partially cut away to reveal the layers forming the article.

FIG. 1A shows a perspective view of an exemplary abrasive article 102 with a partial cutaway. As shown in FIG. 1, the abrasive article 102 has a porous abrasive layer 104, a first filter media 120, a second filter media 140, a third filter media 160, a fourth filter media 180, and an optional attachment layer 146.

The first filter media 120 and the third filter media 160 have discrete channels, as discussed below. The second filter media 140 and fourth filter media 180 are typically made from fibrous materials, such as, for example, a nonwoven fibrous web.

The porous abrasive layer 104 comprises a plurality of openings that allow the flow of particles through the porous abrasive layer 104. The particles are then captured by the filter media within the abrasive article.

Figure 1B:
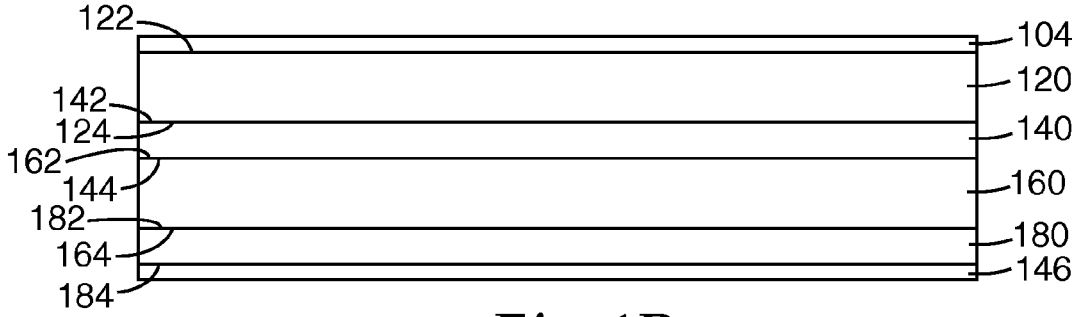
FIG. 1B is a cross-sectional view of the abrasive article shown in FIG. 1A.

FIG. 1B shows a cross-sectional view of the abrasive article shown in FIG. 1A. As shown in FIG. 1B, the abrasive article 102 comprises multiple layers. The first filter media 120 comprises a first surface 122 and a second surface 124 opposite the first surface 122. The second filter media 140 comprises a first surface 142 and a second surface 144 opposite the first surface 142. The third filter media 160 comprises a first surface 162 and a second surface 164 opposite the first surface 162. The fourth filter media 180 comprises a first surface 182 and a second surface 184 opposite the first surface 184.

The first surface 122 of the first filter media 120 is proximate the porous abrasive layer 104. The second surface 124 of the first filter media 120 is proximate the first surface 142 of the second filter media 140. The second surface 144 of the second filter media 140 is proximate the first surface 162 of the third filter media 160. The second surface 164 of the third filter media 160 is proximate the first surface 182 of the fourth filter media 180. An attachment layer 146 is proximate the second surface 184 of the fourth filter media 180.

The attachment layer of the abrasive article of the present disclosure can consist of a layer of adhesive, a sheet material, a molded body, or a combination thereof. The sheet material can comprise, for example, a loop portion or a hook portion of a two-part mechanical engagement system. In another embodiment, the attachment layer comprises a layer of pressure sensitive adhesive with an optional release liner to protect it during handling. In some preferred embodiments, the attachment layer is porous and allows air to pass through.

In some embodiments, the attachment layer of the abrasive article of the present disclosure comprises a nonwoven, woven or knitted loop material. The loop material can be used to affix the abrasive article to a back-up pad having a complementary mating component.

Suitable materials for a loop attachment layer include both woven and nonwoven materials. Woven and knit attachment layer materials can have loop-forming filaments or yarns included in their fabric structure to form upstanding loops for engaging hooks. Nonwoven loop attachment interface materials can have loops formed by the interlocking fibers. In some nonwoven loop attachment interface materials, the loops are formed by stitching a yarn through the nonwoven web to form upstanding loops.

Useful nonwovens suitable for use as a loop attachment layer include, but are not limited to, airlaids, spunbonds, spunlaces, bonded melt blown webs, and bonded carded webs. The nonwoven materials can be bonded in a variety of ways known to those skilled in the art including, for example, needle-punched, stitchbonded, hyrdoentangled, chemical bond, and thermal bond. The woven or nonwoven materials used can be made from natural fibers (e.g., wood or cotton fibers), synthetic fibers (e.g., polyester or polypropylene fibers) or combinations of natural and synthetic fibers. In some embodiments, the attachment layer is made from nylon, polyester or polypropylene.

In some embodiments, a loop attachment layer having an open structure that does not significantly interfere with the flow of air through it is selected. In some embodiments, the attachment layer material is selected, at least in part, based on the porosity of the material. In yet further embodiments, the loop attachment layer is selected to function as the fourth filtering media as well as an attachment layer.

In some embodiments, the attachment layer of the abrasive article of the present disclosure comprises a hook material. The material used to form the hook material useful in the abrasive article of the abrasive article of the present disclosure may be made in one of many different ways known to those skilled in the art. Several suitable processes for making hook material useful in making attachment layers useful for the present disclosure include, for example, methods described in U.S. Pat. No. 5,058,247 (Thomas et al.) (for low cost hook fasteners); U.S. Pat. No. 4,894,060 (Nestegard) (for diaper fasteners), U.S. Pat. No. 5,679,302 (Miller et al.) (entitled "Method for making a mushroom-type hook strip for a mechanical fastener"), and U.S. Pat. No. 6,579,161 (Chesley et al.), each of which is incorporated herein by reference.

The hook material may be a porous material such as, for example the polymer netting material reported in U.S. Publication 2004/0170801 (Seth et al.), which is incorporated herein by reference. In other embodiments, the hook material may be apertured to allow air to pass through. Apertures can be formed in the hook material using any methods known to those skilled in the art. For example, the apertures can be cut from a sheet of hook material using, for example, a die, laser, or other perforating instruments known to those skilled in the art. In other embodiments, the hook material can be formed with apertures.

Figure 2:
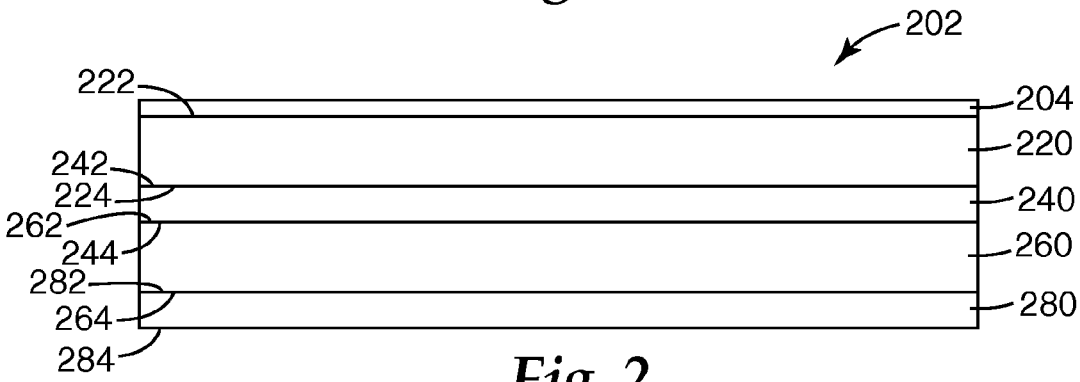
FIG. 2 is a cross-sectional view of an exemplary abrasive article according to the present disclosure having an integral attachment interface.

FIG. 2 shows a cross-sectional view of an exemplary abrasive article according to the present disclosure having an integral attachment interface. As shown in FIG. 2, the abrasive article 202 comprises multiple layers. The first filter media 220 comprises a first surface 222 and a second surface 224 opposite the first surface 222. The second filter media 240 comprises a first surface 242 and a second surface 244 opposite the first surface 242. The third filter media 260 comprises a first surface 262 and a second surface 264 opposite the first surface 262. The fourth filter media 280 comprises a first surface 282 and attachment interface 284 opposite the first surface. Unlike the embodiment shown in FIGS. 1A and 1B, the fourth filter media comprises an integral attachment interface. In some embodiments, the integral attachment interface can function as a loop portion of a two-part mechanical engagement system. The loops can be woven or knitted or formed by fibers of a nonwoven web. In other embodiments, a pressure sensitive adhesive is applied directly to the fourth filter media to function as an attachment interface.

The various layers in the abrasive article of the abrasive article of the present disclosure can be held together using any suitable form of attachment such as, for example, glue, pressure sensitive adhesive, hot-melt adhesive, spray adhesive, thermal bonding, and ultrasonic bonding. In some embodiments, the layers are adhered to one another by applying a spray adhesive such as, for example, "3M BRAND SUPER 77 ADHESIVE", available from 3M Company, St. Paul, Minn., to one side of the porous abrasive. In other embodiments, a hot-melt adhesive is applied to one side of a layer using either a hot-melt spray gun, a hot-melt extruder, or an extruder with a comb-type shim. In yet further embodiments, a preformed adhesive mesh is placed between the layers to be joined. In some embodiments, the various layers in the abrasive article are held together with welds as disclosed, for example, in U.S. application Ser. No. 11/423,829 (Sanders et al.), filed Jun. 13, 2006.

The porous abrasive layer and various filter media layers of the abrasive article of the present disclosure are affixed to one another in a manner that does not prevent the flow of particles from one layer to the next. In some embodiments, the porous abrasive layer and various filter media layers of the abrasive article of the present disclosure are affixed to one another in a manner that does not substantially inhibit the flow of particles from one layer to the next. The level of particle flow through the abrasive article can be restricted, at least in part, by the introduction of an adhesive between the porous abrasive layer and the first filter media, or the first filter media and the second filter media. The level of restriction can be minimized by applying the adhesive between layers in a discontinuous fashion such as for example, as discrete adhesive areas (e.g., atomized spray or starved extrusion die) distinct adhesive lines (e.g., hot melt swirl-spray or patterned roll coater). In some embodiments, the adhesive is applied near the perimeter of the layer.

The attachment layer of the abrasive article of the present disclosure is affixed to the filter media in a manner that does not prevent the flow of air from the filter media. In some embodiments, the attachment layer of the abrasive article of the present disclosure is affixed to the filter media in a manner that does not substantially inhibit the flow of air from the filter media. The level of air flow through the attachment layer can be restricted, at least in part, by the introduction of an adhesive between an attachment layer comprising a sheet material and the filter media. The level of restriction can be minimized by applying the adhesive between the sheet material of the attachment layer and the filter media in a discontinuous fashion such as, for example, discrete adhesive areas (e.g., atomized spray or starved extrusion die) or distinct adhesive lines (e.g., hot melt swirl-spray or patterned roll coater).

Adhesives useful in the present disclosure include both pressure sensitive and non-pressure sensitive adhesives. Pressure sensitive adhesives are normally tacky at room temperature and can be adhered to a surface by application of, at most, light finger pressure, while non-pressure sensitive adhesives include solvent, heat, or radiation activated adhesive systems. Examples of adhesives useful in the present disclosure include those based on general compositions of polyacrylate; polyvinyl ether; diene-containing rubbers such as natural rubber, polyisoprene, and polyisobutylene; polychloroprene; butyl rubber; butadiene-acrylonitrile polymers; thermoplastic elastomers; block copolymers such as styrene-isoprene and styrene-isoprene-styrene block copolymers, ethylene-propylene-diene polymers, and styrene-butadiene polymers; polyalphaolefins; amorphous polyolefins; silicone; ethylene-containing copolymers such as ethylene vinyl acetate, ethylacrylate, and ethylmethacrylate; polyurethanes; polyamides; polyesters; epoxies; polyvinylpyrrolidone and vinylpyrrolidone copolymers; and mixtures of the above. Additionally, the adhesives can contain additives such as tackifiers, plasticizers, fillers, antioxidants, stabilizers, pigments, diffusing particles, curatives, and solvents.

Figure 3B:
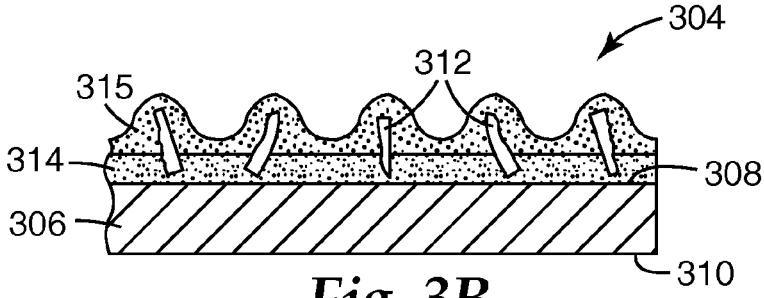
FIG. 3B is a cross-sectional view of the porous abrasive layer shown in FIG. 3A.
Figure 3A:
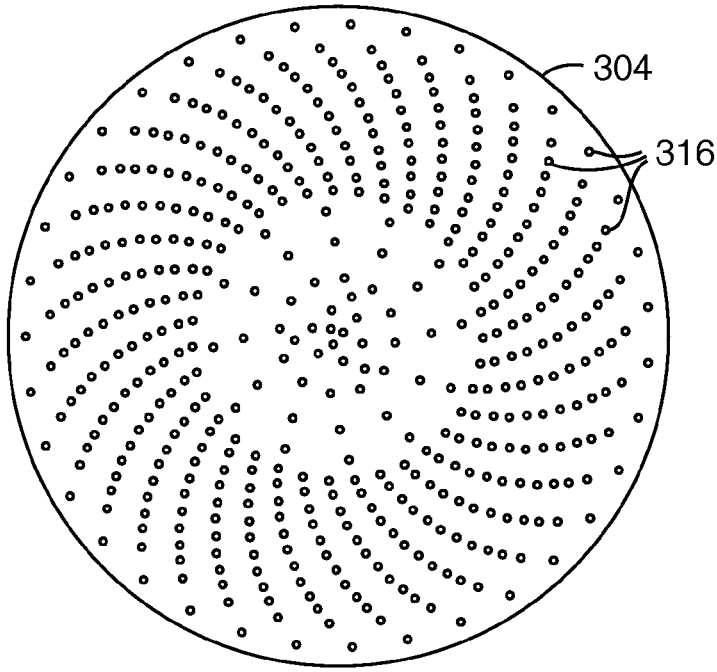
FIG. 3A is a view of an exemplary porous abrasive layer according to the present disclosure.

FIG. 3A shows a view of an exemplary coated abrasive material used to form the porous abrasive layer according to the present disclosure. FIG. 3B shows a cross-sectional view of a section of the porous abrasive layer shown in FIG. 3A. As shown in FIG. 3B, the porous abrasive layer 304 comprises a substrate 306 having a first surface 308 and a second surface 310, a make coat 314, a plurality of abrasive particles 312, and a size coat 315. The make and size coat can be individually or collectively referred to as "binder." As shown in FIG. 3A, the porous abrasive layer 304 comprises a plurality of apertures 316 (not shown in FIG. 3B).

Figure 4:
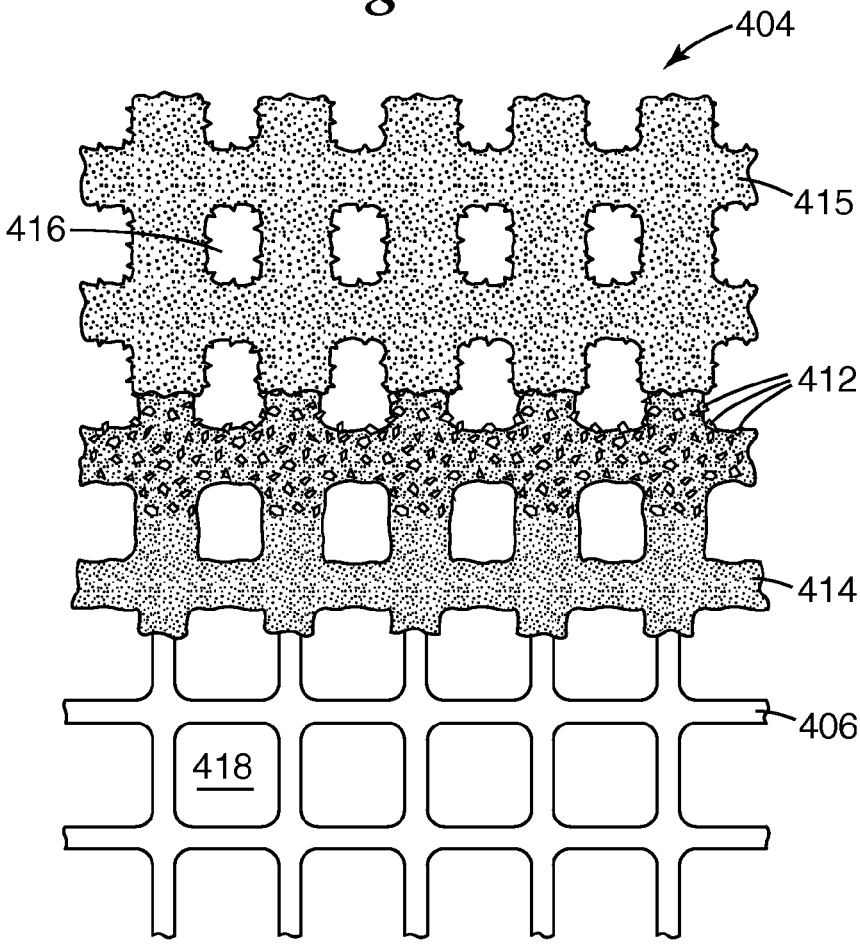
FIG. 4 is a top view of an exemplary porous abrasive layer according to the present disclosure partially cut away to reveal the components forming the abrasive layer.

FIG. 4 shows a top view of an exemplary screen abrasive material used to form the porous abrasive layer according to the present disclosure. FIG. 4 includes a partial cutaway to reveal the components forming the abrasive layer. As shown in FIG. 4, the porous abrasive layer 404 comprises an open mesh substrate 406, a make coat 414, a plurality of abrasive particles 412, and a size coat 415. The porous abrasive layer 404 comprises a plurality of openings 416 that extend through the porous abrasive layer. The openings 416 are formed by openings 418 in the open mesh substrate 406.

The open mesh substrate can be made from any porous material including, for example, perforated films, nonwovens, or woven or knitted fabrics. In the embodiment shown in FIG. 4, the open mesh substrate 406 is a perforated film. The film for the backing can be made from metal, paper, or plastic, including molded thermoplastic materials and molded thermoset materials. In some embodiments, the open mesh substrate is made from perforated or slit and stretched sheet materials. In some embodiments, the open mesh substrate is made from fiberglass, nylon, polyester, polypropylene, or aluminum.

The openings 418 in the open mesh substrate 406 can be generally square shaped as shown in FIG. 4. In other embodiments, the shape of the openings can be other geometric shapes including, for example, a rectangular shape, a circular shape, an oval shape, a triangular shape, a parallelogram shape, a polygon shape, or a combination of these shapes. The openings 418 in the open mesh substrate 406 can be uniformly sized and positioned as shown in FIG. 4. In other embodiments, the openings may be placed non-uniformly by, for example, using a random opening placement pattern, varying the size or shape of the openings, or any combination of random placement, random shapes, and random sizes.

In another aspect, a screen abrasive with a woven or knitted substrate can be used to form the porous abrasive layer in the present disclosure. A woven substrate typically comprises a plurality of generally parallel warp elements that extend in a first direction and a plurality of generally parallel weft elements that extend in a second direction. The weft elements and warp elements of the open mesh substrate intersect to form a plurality of openings. The second direction can be perpendicular to the first direction to form square shaped openings in the woven open mesh substrate. In some embodiments, the first and second directions intersect to form a diamond pattern. The shape of the openings can be other geometric shapes including, for example, a rectangular shape, a circular shape, an oval shape, a triangular shape, a parallelogram shape, a polygon shape, or a combination of these shapes. In some embodiments, the warp and weft elements are yarns that are woven together in a one-over-one weave.

The warp and weft elements may be combined in any manner known to those in the art including, for example, weaving, stitch-bonding, or adhesive bonding. The warp and weft elements may be fibers, filaments, threads, yarns or a combination thereof. The warp and weft elements may be made from a variety of materials known to those skilled in the art including, for example, synthetic fibers, natural fibers, glass fibers, and metal. In some embodiments, the warp and weft elements comprise monofilaments of thermoplastic material or metal wire. In some embodiments, the woven open mesh substrate comprises nylon, polyester, or polypropylene.

The porous abrasive layer, whether a screen abrasive, a perforated coated abrasive, or otherwise, may comprise openings having different open areas. The "open area" of an opening in the porous abrasive layer refers to the area of the opening as measured over the thickness of the porous abrasive layer (i.e., the area bounded by the perimeter of material forming the opening through which a three-dimensional object could pass). Porous abrasive layers useful in the present disclosure typically have an average open area of at least about 0.5 square millimeters per opening. In some embodiments, the porous abrasive layer has an average open area of at least about 1 square millimeter per opening. In yet further embodiments, the porous abrasive layer has an average open area of at least about 1.5 square millimeters per opening.

Typically, porous abrasive layers have an average open area that is less than about 100 square millimeters per opening. In some embodiments, the porous abrasive layer has an average open area that is less than about 50 square millimeters per opening. In yet further embodiments, the porous abrasive layer has an average open area that is less than about 10 square millimeters per opening.

The porous abrasive layer, whether woven, perforated or otherwise, comprises a total open area that affects the amount of air that can pass through the porous abrasive layer as well as the effective area and performance of the abrasive layer. The "total open area" of the porous abrasive layer refers to the cumulative open areas of the openings as measured over the area formed by the perimeter of the porous abrasive layer. Porous abrasive layers useful in the present disclosure have a total open area of at least about 0.01 square centimeters per square centimeter of the abrasive layer (i.e., 1 percent open area). In some embodiments, the porous abrasive layer has a total open area of at least about 0.03 square centimeters per square centimeter of the abrasive layer (i.e., 3 percent open area). In yet further embodiments, the porous abrasive layer has a total open area of at least about 0.05 square centimeters per square centimeter of the abrasive layer (i.e., 5 percent open area).

Typically, porous abrasive layers useful in the present disclosure have a total open area that is less than about 0.95 square centimeters per square centimeter of the abrasive layer (i.e., 95 percent open area). In some embodiments, the porous abrasive layer has a total open area that is less than about 0.9 square centimeters per square centimeter of the abrasive layer (i.e., 90 percent open area). In yet further embodiments, the porous abrasive layer has a total open area that is less than about 0.80 square centimeters per square centimeter of the abrasive layer (i.e., 80 percent open area).

As discussed above, the porous abrasive layer, whether a perforated coated abrasive, a coated screen abrasive, a nonwoven abrasive, or otherwise, comprises a plurality of abrasive particles and at least one binder. In some embodiments, the abrasive layer comprises a make coat, a size coat, a supersize coat, or a combination thereof. In some embodiments, a treatment can be applied to the substrate such as, for example, a presize, a backsize, a subsize, or a saturant.

Typically, the make layer of a coated abrasive is prepared by coating at least a portion of the substrate (treated or untreated) with a make layer precursor. Abrasive particles are then at least partially embedded (e.g., by electrostatic coating) to the make layer precursor comprising a first binder precursor, and the make layer precursor is at least partially cured. Electrostatic coating of the abrasive particles typically provides erectly oriented abrasive particles. In the context of the abrasive article of the present disclosure, the term "erectly oriented" refers to a characteristic in which the longer dimensions of a majority of the abrasive particles are oriented substantially perpendicular (i.e., between 60 and 120 degrees) to the backing. Other techniques for erectly orienting abrasive particles can also be used.

Next, the size layer is prepared by coating at least a portion of the make layer and abrasive particles with a size layer precursor comprising a second binder precursor (which may be the same as, or different from, the first binder precursor), and at least partially curing the size layer precursor. In some coated abrasive articles, a supersize is applied to at least a portion of the size layer. If present, the supersize layer typically includes grinding aids and/or anti-loading materials.

Typically, a binder is formed by curing (e.g., by thermal means, or by using electromagnetic or particulate radiation) a binder precursor. Useful first and second binder precursors are known in the abrasive art and include, for example, free-radically polymerizable monomer and/or oligomer, epoxy resins, acrylic resins, urethane resins, phenolic resins, urea-formaldehyde resins, melamine-formaldehyde resins, aminoplast resins, cyanate resins, or combinations thereof. Useful binder precursors include thermally curable resins and radiation curable resins, which may be cured, for example, thermally and/or by exposure to radiation.

Suitable abrasive particles for the coated abrasives useful in the present disclosure can be any known abrasive particles or materials commonly used in abrasive articles. Examples of useful abrasive particles for coated abrasives include, for example, fused aluminum oxide, heat treated aluminum oxide, white fused aluminum oxide, black silicon carbide, green silicon carbide, titanium diboride, boron carbide, tungsten carbide, titanium carbide, diamond, cubic boron nitride, garnet, fused alumina zirconia, sol gel abrasive particles, silica, iron oxide, chromia, ceria, zirconia, titania, silicates, metal carbonates (such as calcium carbonate (e.g., chalk, calcite, marl, travertine, marble and limestone), calcium magnesium carbonate, sodium carbonate, magnesium carbonate), silica (e.g., quartz, glass beads, glass bubbles and glass fibers) silicates (e.g., talc, clays, (montmorillonite) feldspar, mica, calcium silicate, calcium metasilicate, sodium aluminosilicate, sodium silicate) metal sulfates (e.g., calcium sulfate, barium sulfate, sodium sulfate, aluminum sodium sulfate, aluminum sulfate), gypsum, aluminum trihydrate, graphite, metal oxides (e.g., tin oxide, calcium oxide), aluminum oxide, titanium dioxide and metal sulfites (e.g., calcium sulfite), metal particles (e.g., tin, lead, copper), plastic abrasive particles formed from a thermoplastic material (e.g., polycarbonate, polyetherimide, polyester, polyethylene, polysulfone, polystyrene, acrylonitrile-butadiene-styrene block copolymer, polypropylene, acetal polymers, polyvinyl chloride, polyurethanes, nylon), plastic abrasive particles formed from crosslinked polymers (e.g., phenolic resins, aminoplast resins, urethane resins, epoxy resins, melamine-formaldehyde, acrylate resins, acrylated isocyanurate resins, urea-formaldehyde resins, isocyanurate resins, acrylated urethane resins, acrylated epoxy resins), and combinations thereof. The abrasive particles may also be agglomerates or composites that include additional components, such as, for example, a binder. Criteria used in selecting abrasive particles used for a particular abrading application typically include: abrading life, rate of cut, substrate surface finish, grinding efficiency, and product cost.

Coated abrasives useful in the present disclosure can further comprise optional additives such as abrasive particle surface modification additives, coupling agents, plasticizers, fillers, expanding agents, fibers, antistatic agents, initiators, suspending agents, photosensitizers, lubricants, wetting agents, surfactants, pigments, dyes, UV stabilizers, and suspending agents. The amounts of these materials are selected to provide the properties desired. Additives may also be incorporated into the binder, applied as a separate coating, held within the pores of the agglomerate, or combinations of the above.

Figure 5A:
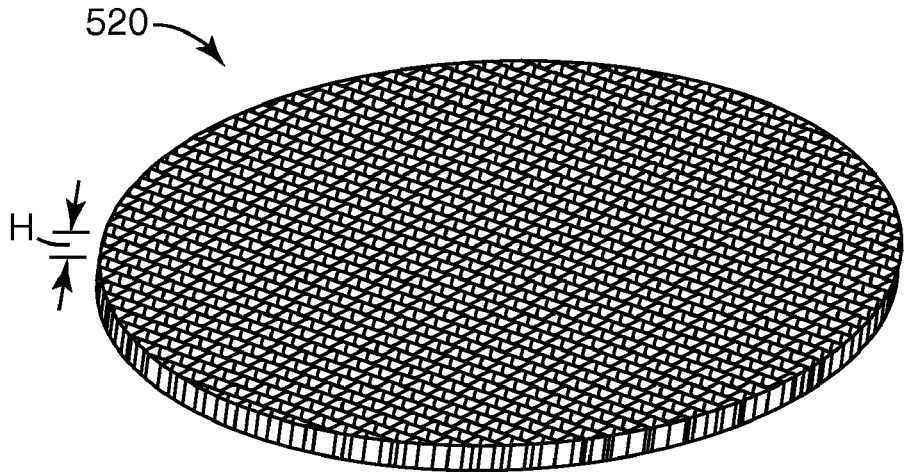
FIG. 5A is a perspective view of an exemplary first filter media layer comprising stacked film layers according to the present disclosure.
Figure 5B:
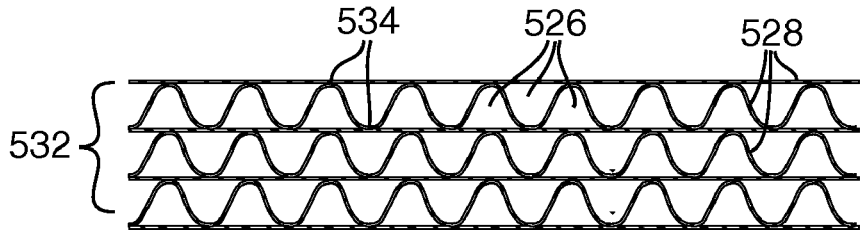
FIG. 5B is a top view of a portion of the exemplary first filter media layer shown in FIG. 5A.

FIG. 5A shows a perspective view of an exemplary filter media useful as first filter media and third filter media of the present disclosure comprising stacked film layers. FIG. 5B shows a top view of a portion of the exemplary filter media layer shown in FIG. 5A. As shown in FIG. 5A, the media layer has a thickness or height H. The height of the first and third filter media can be varied to accommodate varying applications. For example, if the particular abrading application demands an abrasive article with large particulate holding capacity, the height of the first or third filter media can be increased. The height of the first and third filter media can be defined by other parameters including, for example, the desired rigidity of the abrasive article. In some embodiments, the first and third filter media of the abrasive article of the present disclosure is relatively rigid in comparison to the other filter media used in the abrasive article.

First and third filter media useful in the present disclosure typically have an average height of at least about 0.5 millimeter. In some embodiments, the first filter media has an average height of at least about 1 millimeter. In yet further embodiments, the first filter media has an average height of at least about 3 millimeters.

Typically, first and third filter media useful in the present disclosure each have an average height that is less than about 30 millimeters. In some embodiments, the first and third filter media each have an average height that is less than about 20 millimeters. In yet further embodiments, the first and third filter media each have an average height that is less than about 10 millimeters.

As shown in FIG. 5B, an exemplary first or third filter media useful in the present disclosure comprises a stack 532 of polymer films that form the sidewalls 528 of channels 526 that extend through the height of the first or third filter media 520. The sidewalls 528 are held together at bond areas 534. First and third filter media that can be included in the abrasive article of the abrasive article of the present disclosure include, for example, the filter media described in U.S. Pat. No. 6,280,824 (Insley et al.), U.S. Pat. No. 6,454,839 (Hagglund et al.), and U.S. Pat. No. 6,589,317 (Zhang et al.), each of which is incorporated herein by reference.

Polymers useful in forming the polymer film sidewalls of a first and third filter media that can be used in the present disclosure include, but are not limited to, polyolefins such as polyethylene and polyethylene copolymers, polypropylene and polypropylene copolymers, polyvinylidene difluoride (PVDF), and polytetrafluoroethylene (PTFE). Other polymeric materials include acetates, cellulose ethers, polyvinyl alcohols, polysaccharides, polyesters, polyamides, poly(vinyl chloride), polyurethanes, polyureas, polycarbonates, and polystyrene. The polymer film layers can be cast from curable resin materials such as acrylates or epoxies and cured through free radical pathways promoted chemically, by exposure to heat, UV, or electron beam radiation. In some preferred embodiments, the polymer film layers are formed of polymeric material capable of being charged, namely, dielectric polymers and blends such as polyolefins or polystyrenes.

The polymer film layers may have structured surfaces defined on one or both faces as reported, for example, in U.S. Pat. No. 6,280,824 (Insley et al.), incorporated herein by reference. The structured surfaces can be in the shape of upstanding stems or projections, e.g., pyramids, cube corners, J-hooks, mushroom heads, or the like; continuous or intermittent ridges; e.g., rectangular or v-shaped ridges with intervening channels; or combinations thereof. These projections can be regular, random or intermittent or be combined with other structures such as ridges. The ridge-type structures can be regular, random intermittent, extend parallel to one another, or be at intersecting or nonintersecting angles and be combined with other structures between the ridges, such as nested ridges or projections. Generally, the high aspect ratio structures can extend over all or just a region of a film. When present in a film region, the structures provide a surface area greater than a corresponding planar film.

The structured surfaces can be made by any known method of forming a structured film such as the methods disclosed in U.S. Pat. Nos. 5,069,403 and 5,133,516, both to Marantic et al.; U.S. Pat. No. 5,691,846 to Benson et al.; U.S. Pat. No. 5,514,120 to Johnston et al.; U.S. Pat. No. 5,175,030 to Lu et al.; U.S. Pat. No. 4,668,558 to Barber; U.S. Pat. No. 4,775,310 to Fisher; U.S. Pat. No. 3,594,863 to Erb or U.S. Pat. No. 5,077,870 to Melbye et al. These methods are all incorporated by reference in their entirety.

Figure 6:
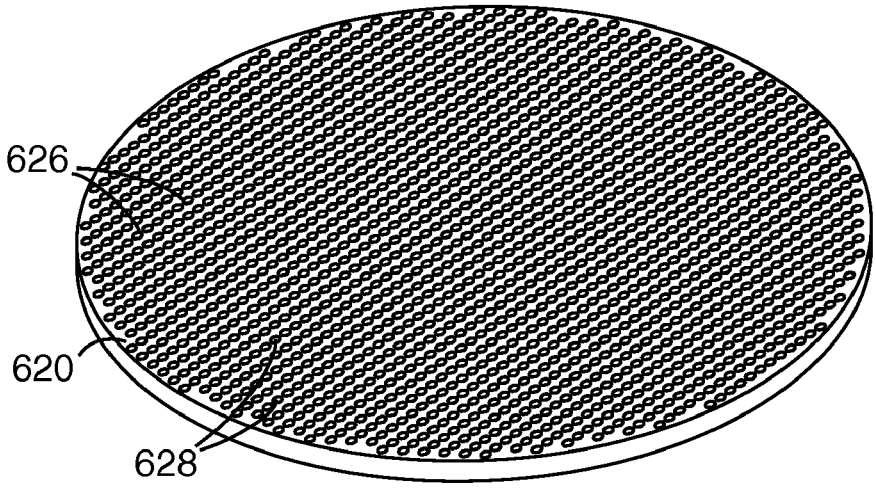
FIG. 6 is a perspective view of an exemplary first filter media layer comprising a perforated body according to the present disclosure.

FIG. 6 shows a perspective view of another exemplary first or third filter media layer useful in the present disclosure comprising a perforated body. As shown in FIG. 6, the filter media 620 comprises a plurality of channels 626 with channel sidewalls 628 extending from the first surface to the second surface of the filter media. The filter media shown in FIG. 6 can be constructed from a variety of materials including, for example, foam, paper, or plastic, including molded thermoplastic materials and molded thermoset materials. In some embodiments, the first filter media is made from perforated porous foam material. In yet further embodiments, the first filter media is made from perforated or slit and stretched sheet materials. In some embodiments utilizing a perforated body as a first filter media, the perforated body is made from fiberglass, nylon, polyester, or polypropylene.

The first and third filter media have discrete channels that extend from the first surface to the second surface of each filter media. The channels can have a non-tortuous path that extends directly from the first surface to the second surface of the filter media. The cross-sectional area of the channels can be described in terms of an effective circular diameter, which is the diameter of the largest circle that will pass through an individual channel.

Filter media with discrete channels useful in the present disclosure typically have channels with an average effective circular diameter of at least about 0.1 millimeter. In some embodiments, the filter media has channels with an average effective circular diameter of at least about 0.3 millimeters. In yet further embodiments, the filter media has channels with an average effective circular diameter of at least about 0.5 millimeters.

Typically, filter media with discrete channels useful in the present disclosure have channels with an average effective circular diameter that is less than about 2 millimeters. In some embodiments, the filter media have channels with an average effective circular diameter that is less than about 1 millimeter. In yet further embodiments, the filter media have channels with an average effective circular diameter that is less than about 0.5 millimeters.

The filter media, including the first, second, third, and fourth filter media, of the abrasive article of the present disclosure can be electrically charged. Electrical charging enhances the filter media's ability to remove particulate matter from a fluid stream by increasing the attraction between particles and the surface of the filter media. Non-impinging particles passing close to sidewalls are more readily pulled from the fluid stream, and impinging particles are adhered more strongly. Passive electrostatic charging is provided by an electret, which is a dielectric material that exhibits an electrical charge that persists for extended time periods. Electret chargeable polymeric materials include nonpolar polymers such as polytetrafluoroethylene (PTFE) and polypropylene.

Several methods are used to charge dielectric materials, any of which may be used to charge the filtration media of the abrasive article of the present disclosure, including corona discharge, heating and cooling the material in the presence of a charged field, contact electrification, spraying the web with charged particles, and impinging a surface with water jets or water droplet streams. In addition, the chargeability of the surface may be enhanced by the use of blended materials. Examples of charging methods are disclosed in the following patents: U.S. Pat. No. RE30,782 (van Turnhout et al.), U.S. Pat. No. RE31,285 (van Turnhout et al.), U.S. Pat. No. 5,496,507 (Angadjivand et al.), U.S. Pat. No. 5,472,481 (Jones et al.), U.S. Pat. No. 4,215,682 (Kubik et al.), U.S. Pat. No. 5,057,710 (Nishiura et al.) and U.S. Pat. No. 4,592,815 (Nakao).

The second and fourth filter media can include a wide variety of types of porous filter media conventionally used in filtration products, particularly air filtration products. The second and fourth filter media can be identical or different from one another. The second and/or fourth filter media can be a fibrous material, a foam, a porous membrane, tissue, and the like. In some embodiments, the second and/or fourth filter media comprises a fibrous material. The second and/or fourth filter media can be a fibrous filter web such as a nonwoven fibrous web, although woven and knitted webs can also be used.

In some embodiments, the second and/or fourth filter media comprises fibrous materials having a fiber size that is less than about 100 microns in diameter, and sometimes less than about 50 microns, and sometimes less than about 1 micron in diameter. A wide variety of basis weights can be used in the second and fourth filter media. If desired, the second and fourth filter media can include one or more layers (webs) of filter media. In some embodiments, the basis weight of the second filter media is less than the basis weight of the first filter media.

The basis weight of the second filter media is typically in the range of about 2 grams per square meter to about 200 grams per square meter. In some embodiments, the second filter media is in the range of about 5 grams per square meter to about 100 grams per square meter. In yet further embodiments, the second filter media is in the range of about 10 grams per square meter to about 70 grams per square meter.

The basis weight of the fourth filter media is typically in the range of about 10 grams per square meter to about 1000 grams per square meter. In some embodiments, the fourth filter media is in the range of about 30 grams per square meter to about 500 grams per square meter. In yet further embodiments, the fourth filter media is in the range of about 50 grams per square meter to about 200 grams per square meter.

The second and fourth filter media can be made from a wide variety of organic polymeric materials, including mixtures and blends. Suitable filter media includes a wide range of materials commercially available. They include polyolefins, such as polypropylene, linear low density polyethylene, poly-1-butene, poly(4-methyl-1-pentene), polytetrafluoroethylene, polytrifluorochloroethylene; or polyvinylchloride; aromatic polyarenes, such as polystyrene; polycarbonates; polyesters; and combinations thereof (including blends or copolymers). In some embodiments, materials include polyolefins free of branched alkyl radicals and copolymers thereof. In yet further embodiments, materials include thermoplastic fiber formers (e.g., polyolefins such as polyethylene, polypropylene, copolymers thereof, etc.). Other suitable materials include: thermoplastic polymers such as polylactic acid (PLA); non-thermoplastic fibers such as cellulose, rayon, acrylic, and modified acrylic (halogen modified acrylic); polyamide or polyimide fibers such as those available under the tradenames NOMEX and KEVLAR from DuPont; and fiber blends of different polymers.

In embodiments employing a nonwoven material as the filter media, the nonwoven filter media can be formed in a web by conventional nonwoven techniques including melt blowing, spunbonding, carding, air laying (dry laying), wet laying, or the like. If desired, the fibers or webs can be charged by known methods, including, for example, by use of corona discharge electrodes or high-intensity electric fields or chemical coating processes. The fibers can be charged during fiber formation, prior to or while forming the fibers into the filter web or subsequent to forming the filter web. The fibers forming the media filter can even be charged subsequent to being joined to the first filter media. The second and/or fourth filter media can comprise fibers coated with a polymer binder or adhesive, including pressure sensitive adhesives.

The ordinal designation of the first, second, third, and fourth filter media within the context of the present disclosure pertains only to the designated layers and is exclusive of other optional layers that may be used in abrasive articles of the present invention. For example, if the embodiment shown in FIG. 1A had an additional layer of material between the porous abrasive layer 104 and the first filter media 120, such as, for example, an optional filter layer, the first filter media 120 remains designated the first filter media for purposes of the present disclosure, even though it is actually the "second" filter away from the abrasive layer. Likewise, if an additional layer of material is placed between the second filter media 140 and third filter media 160, this does not alter the designation of the second filter media 140 and third filter media 160.

The abrasive articles of the abrasive article of the present disclosure have been found to be efficient in collecting large amounts of particles at high rates of delivery. The multiple filter components used in the present disclosure have been found to overcome deficiencies with current abrasive articles. Although not wishing to be bound by any particular theory, it is believed that in the case of the abrasive article of the present disclosure, the multiple filter components can function such that a given component (e.g., the first filter media) can be aided by secondary components (e.g., the second, third, or fourth filter media) that can address the failure mode of the first component and compensate, keeping overall efficiency high and extending performance to a level that aligns with the performance of the abrasive it is used with.

Advantages and other embodiments of this invention are further illustrated by the following examples, but the particular materials and amounts thereof recited in these examples, as well as other conditions and details, should not be construed to unduly limit this invention. All parts and percentages are by weight unless otherwise indicated.

EXAMPLES

The following abbreviations are used throughout the Examples:

Materials

Figure 7:
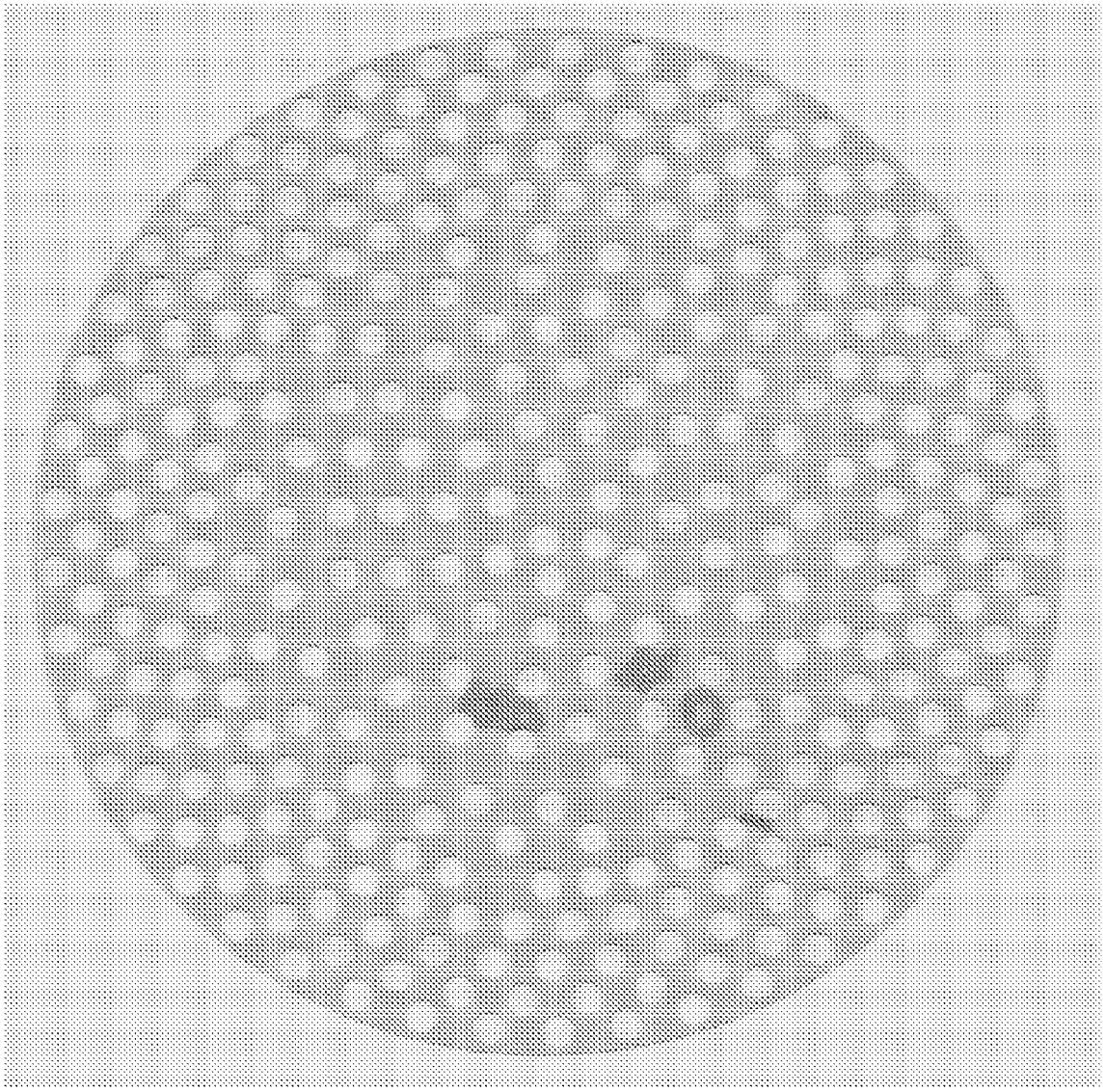
FIG. 7 is a photograph of the abrasive layer identified in the examples as "AM".

| Identification | Description |
|---|---|
| AM | A coated abrasive material, commercially available under the trade designation "734U GRADE P80" from 3M Company; St. Paul, Minnesota, die cut to 5 inch (12.7 cm) diameter discs having a distribution of laser perforated holes according to the drawing in FIG. 7. |
| FM1 | An electrostatically charged staple fiber web, 100 grams per square meter basis weight, commercially available under the trade designation "FILTRETE G100" from 3M Company |
| FM2 | An electrostatically charged staple fiber web, 30 grams per square meter basis weight, commercially available under the trade designation "FILTRETE G30" from 3M Company |
| FM3 | 5 millimeter thick corrugated polypropylene multilayer filter media, commercially available under the trade designation "3M HIGH AIRFLOW AIR FILTRATION MEDIA (HAF); 5MM" from 3M Company |
| FM4 | 10 millimeter thick corrugated polypropylene multilayer filter media, commercially available under the trade designation "3M HIGH AIRFLOW AIR FILTRATION MEDIA (HAF); 10MM" from 3M Company |
| AT | A loop attachment material, commercially available under the trade designation "70 G/M$^2$ TRICOT DAYTONA BRUSHED NYLON LOOP FABRIC" from Sitip SpA, Gene, Italy. |

Sample Preparation Description

Example 1

Approximately 5 inch (12.7 cm) diameter discs of attachment media, AT, Filter media 1, FM1, Filter media 2, FM2 and Filter media 3, FM3, were die cut from larger sheets of the respective substrates. These approximate 5 inch (12.7 cm) diameter discs were used in the construction of a sample disc. A pressure sensitive adhesive, commercially available under the trade designation "SUPER 77 SPRAY ADHESIVE" from 3M Company, was applied to the non loop side of the approximate 5 inch (12.7 cm) diameter disc of attachment media, AT, and allowed to dry for approximately 30 seconds at 25 degrees Celsius. The dry weight of adhesive was about 12 milligrams per square centimeter (mg/cm$^2$). This drying procedure was used in all pressure sensitive adhesive application steps. A disc of filter media FM1 was laminated to the adhesive coated surface of AT, forming a two-layer construction, such that the two discs were substantially coextensive. A similar amount of the pressure sensitive adhesive was then sprayed on the exposed surface of the FM1 disc and allowed to dry. A disc of FM3 was laminated to the adhesive coated surface of FM1, forming a three-layer construction, such that the discs were substantially coextensive. Next, a thin, flowable bead of 3M Hot Melt Adhesive 3764-PG from 3M Company was applied on the opposite face of FM3 along its outer diameter. While the bead of adhesive was still flowable, a disc of FM2 was laminated to FM3, forming a four-layer construction, such that the discs were substantially coextensive. During lamination, pressure was applied to enable the bead of adhesive to make good contact with both FM3 and FM2. The hot melt adhesive was allowed to cool and harden. A thin, flowable bead of 3M Hot Melt Adhesive 3764-PG was then applied on the top surface, i.e. face, of a new disc of FM3 along its outer diameter. While the bead of adhesive was still flowable, the disc of FM3 was laminated to FM2 of the four-layer construction, forming a five-layer construction, such that the discs were substantially coextensive. During lamination, pressure was applied to enable the bead of adhesive to make good contact with both FM3 and FM2. The hot melt adhesive was allowed to cool and harden. A disc of abrasive media, AM, was then spray coated with a similar amount of pressure sensitive adhesive on it back surface, i.e., non-abrasive surface. The adhesive was allowed to dry. A sample disc was formed by laminating together the adhesive coated AM surface and the exposed side of FM3, of the five-layer construction, forming a six-layer construction, such that the discs were substantially coextensive.

Comparative Example A

Comparative Example A was prepared identically to Example 1 with the following modifications. The fourth layer of the construction, FM2, the fifth layer of the construction, FM3 and the two hot melt adhesive application steps were not used in this construction. A sample disc was formed by laminating together the adhesive coated AM surface and the exposed side of FM3, of the three-layer construction, forming a four-layer construction, such that the discs were substantially coextensive.

Comparative Example B

Comparative Example B was prepared identically to Comparative Example A with the following modification. The disc of FM3 was replaced by a disc of filter media 4, FM4, which had been die cut from a larger sheet of the substrate. A sample disc was formed by laminating together the adhesive coated AM surface and the exposed side of FM4, of the three-layer construction, forming a four layer construction, such that the discs were substantially coextensive.

Sanding Test Procedure

A 5-inch (12.7 centimeter) sample disc was attached to a 5-inch (12.7 cm) diameter by ⅜-inch (0.95 cm) thick foam back up pad, available under the trade designation "Dynabrade Back-Up Pad model "56320" from Dynabrade Corporation, Clarence, N.Y. The backup pad and disc assembly was weighed, then mounted onto a dual-action orbital sander, model "21033", obtained from Dynabrade Corporation. The hose and bag assembly was detached from the sander.

The abrasive face of the disc was brought into contact with a pre-weighed 18-inch by 30 inch (45.7 by 76.2 cm) gel-coated fiberglass reinforced plastic panel, from Whitebear Boatworks, White Bear Lake, Minn. The sander was run at 91.5 pounds per square inch (630.9 kilopascals (Kpa)) air line pressure in a vertical position for 20 seconds. After the 20 s interval, the test panel, which had been cleaned by blowing compressed air across its surface, and sample with backup pad were re-weighed. The back-up pad with sample was remounted on the sander and sanding of the panel was continued. This sequence of sanding, re-weighing of the sample disc and cleaned panel, and continued sanding was maintained for the following additional time intervals; 20, 20, 30, 30, 30, 30, 30, 30, 30 and 30 seconds; for a total sanding time of 5 minutes. In some cases, shorter total time duration was used by elimination of some of the latter 30 second intervals.

The following measurements were made per each test interval:

"Cut": Weight, in grams, removed from the plastic panel;

"Retain": weight, in grams, of swarf collected in the sample disc; and

"DE %": Ratio of the Retain/Cut multiplied by 100.

Example 1 and Comparative Examples A and B were prepared according to the Sample Preparation Description and tested using the Sanding Test Procedure. Results for the cut, retain and DE % for each time interval and for the cumulative sanding time are shown in Tables 1 and 2, respectively.

TABLE 1

| Sanding Interval Time | Example 1 | | | Comparative Example A | | | Comparative Example B | | |
|---|---|---|---|---|---|---|---|---|---|
| (Seconds) | Cut | Retain | DE % | Cut | Retain | DE % | Cut | Retain | DE % |
| 20 | 2.02 | 1.44 | 71.3 | 2.30 | 1.88 | 81.7 | 2.77 | 1.80 | 65.0 |
| 20 | 1.85 | 1.38 | 74.6 | 2.21 | 1.56 | 70.6 | 2.56 | 1.62 | 63.3 |
| 20 | 1.83 | 1.26 | 68.9 | 2.81 | 1.84 | 65.5 | 3.13 | 1.33 | 42.5 |
| 30 | 2.34 | 1.66 | 70.9 | 2.64 | 1.24 | 47.0 | 2.93 | 1.04 | 35.5 |
| 30 | 1.85 | 1.13 | 61.1 | 2.63 | 0.28 | 10.6 | 3.26 | 0.52 | 16.0 |
| 30 | 1.86 | 0.91 | 48.9 | 2.23 | 0.03 | 1.3 | 2.70 | 0.40 | 14.8 |
| 30 | 1.68 | 0.52 | 31.0 | | | | | | |
| 30 | 1.78 | 0.60 | 33.7 | | | | | | |
| 30 | 1.65 | 0.46 | 27.9 | | | | | | |
| 30 | 1.53 | 0.28 | 18.3 | | | | | | |
| 30 | 1.74 | 0.32 | 18.4 | | | | | | |

TABLE 2

| Cumulative Sanding Time | Example 1 | | | Comparative Example A | | | Comparative Example B | | |
|---|---|---|---|---|---|---|---|---|---|
| (seconds) | Cut | Retain | DE % | Cut | Retain | DE % | Cut | Retain | DE % |
| 20 | 2.02 | 1.44 | 71.3 | 2.30 | 1.88 | 81.7 | 2.77 | 1.80 | 65.0 |
| 40 | 3.87 | 2.82 | 72.9 | 4.51 | 3.44 | 76.3 | 5.33 | 3.42 | 64.1 |
| 60 | 5.70 | 4.08 | 71.6 | 7.32 | 5.28 | 72.1 | 8.46 | 4.75 | 56.1 |
| 90 | 8.04 | 5.74 | 71.4 | 9.96 | 6.52 | 65.5 | 11.39 | 5.79 | 50.8 |
| 120 | 9.89 | 6.87 | 69.5 | 12.59 | 6.80 | 54.0 | 14.65 | 6.31 | 43.1 |
| 150 | 11.75 | 7.78 | 66.2 | 14.82 | 6.83 | 46.1 | 17.35 | 6.71 | 38.7 |
| 180 | 13.43 | 8.30 | 61.8 | | | | | | |
| 210 | 15.21 | 8.90 | 58.5 | | | | | | |
| 240 | 16.86 | 9.36 | 55.5 | | | | | | |
| 270 | 18.39 | 9.64 | 52.4 | | | | | | |
| 300 | 20.13 | 9.96 | 49.5 | | | | | | |

It is to be understood that even in the numerous characteristics and advantages of the abrasive article of the present disclosure set forth in above description and examples, together with details of the structure and function of the invention, the disclosure is illustrative only. Changes can be made to detail, especially in matters of shape, size and arrangement of the filter media layers and methods of making and using within the principles of the invention to the full extent indicated by the meaning of the terms in which the appended claims are expressed and the equivalents of those structures and methods.

What is claimed is:

1. An abrasive article comprising:

a porous abrasive layer having an abrasive surface, the porous abrasive layer comprising a substrate having a first surface, a second surface opposite the first surface, a plurality of abrasive particles affixed to the first surface with at least one binder, and a plurality of openings extending from the abrasive surface to the second surface of the porous abrasive layer;

a first filter media having a first surface and a second surface opposite the first surface, the first surface of the first filter media proximate the second surface of the porous abrasive layer, the first filter media comprising a plurality of discrete channels formed by a plurality of channel sidewalls, the channels extending from the first surface of the first filter media to the second surface of the first filter media, the first filter media having a height in the range of 0.5 to 10 millimeters;

a second filter media having a first surface and a second surface opposite the first surface, the first surface of the second filter media proximate the second surface of the first filter media;

a third filter media having a first surface and a second surface opposite the first surface, the first surface of the third filter media proximate the second surface of the second filter media, the third filter media comprising a plurality of discrete channels formed by a plurality of channel sidewalls, the channels extending from the first surface of the third filter media to the second surface of the third filter media, the third filter media having a height in the range of 0.5 to 10 millimeters; and a fourth filter media having a first surface and a second surface opposite the first surface, the first surface of the fourth filter media proximate the second surface of the third filter media.

2. The abrasive article of claim 1 wherein the porous abrasive layer comprises an apertured coated abrasive.

3. The abrasive article of claim 1 wherein the porous abrasive layer comprises a screen abrasive.

4. The abrasive article of claim 1 wherein the channel sidewalls of the first and third filter media comprise polymer film.

5. The abrasive article of claim 4 wherein the polymer film comprises a polymer selected from the group consisting of polypropylene, polyethylene, polytetrafluoroethylene, and combinations thereof.

6. The abrasive article of claim 4 wherein the polymer film comprises a structured surface.

7. The abrasive article of claim 4 wherein the polymer film comprises an electrostatic charge.

8. The abrasive article of claim 1 wherein the plurality of channels of the first filter media comprise an average effective circular diameter of at least 0.1 millimeter.

9. The abrasive article of claim 1 wherein the second filter media comprises a nonwoven.

10. The abrasive article of claim 9 wherein the nonwoven comprises polyolefin fibers and has a basis weight in the range of 10 to 70 grams per square meter.

11. The abrasive article of claim 9 wherein the nonwoven comprises an electrical charge.

12. The abrasive article of claim 1 wherein the fourth filter media comprises a nonwoven.

13. The abrasive article of claim 12 wherein the nonwoven comprises polyolefin fibers and has a basis weight in the range of 50 to 200 grams per square meter.

14. The abrasive article of claim 12 wherein the nonwoven comprises an adhesive.

15. The abrasive article of claim 12 wherein the nonwoven comprises an electrical charge.

16. The abrasive article of claim 1 wherein the second surface of the porous abrasive layer and the first surface of the first filter media are coextensive, the second surface of the first filter media and the first surface of the second filter media are coextensive, the second surface of the second filter media and the first surface of the third filter media are coextensive, and the second surface of the third filter media and the first surface of the fourth filter media are coextensive.

17. An abrasive article comprising:

a porous abrasive layer having an abrasive surface, the porous abrasive layer comprising a substrate having a first surface, a second surface opposite the first surface, a plurality of abrasive particles affixed to the first surface with at least one binder, and a plurality of openings extending from the abrasive surface to the second surface of the porous abrasive layer;

a first filter media having a first surface and a second surface opposite the first surface, the first surface of the first filter media proximate the second surface of the porous abrasive layer, the first filter media comprising a plurality of discrete channels formed by a plurality of channel sidewalls, the channels extending from the first surface of the first filter media to the second surface of the first filter media;

a second filter media having a first surface and a second surface opposite the first surface, the first surface of the second filter media proximate the second surface of the first filter media;

a third filter media having a first surface and a second surface opposite the first surface, the first surface of the third filter media proximate the second surface of the second filter media, the third filter media comprising a plurality of discrete channels formed by a plurality of channel sidewalls, the channels extending from the first surface of the third filter media to the second surface of the third filter media;

a fourth filter media having a first surface and a second surface opposite the first surface, the first surface of the fourth filter media proximate the second surface of the third filter media, and an attachment layer affixed to the second surface of the fourth filter media, wherein the attachment layer comprises a loop portion or a hook portion of a two-part mechanical engagement system;

wherein the second and fourth filter media comprise a nonwoven.

18. The abrasive article of claim 17 wherein the first, second, third, and fourth filter media are affixed to one another with an adhesive.

19. The abrasive article of claim 17 wherein the first, second, third, and fourth filter media are affixed to one another by welds.

* * * * *